United States Patent [19]

Ujihara

[11] Patent Number: 4,719,993

[45] Date of Patent: Jan. 19, 1988

[54] CONTROL APPARATUS FOR ELEVATOR

[75] Inventor: Hideyo Ujihara, Inazawa, Japan

[73] Assignee: Mitsubishi Denki Kabushiki Kaisha, Tokyo, Japan

[21] Appl. No.: 22,250

[22] Filed: Mar. 5, 1987

[30] Foreign Application Priority Data

Mar. 6, 1986 [JP] Japan ..... 61-48964

[51] Int. Cl.[4] ..... B66B 1/18

[52] U.S. Cl. ..... 187/101; 187/102; 364/133

[58] Field of Search ..... 187/100–102, 187/130; 364/131, 133, 184, 186

[56] References Cited

U.S. PATENT DOCUMENTS

| | | | |
|---|---|---|---|
| 4,193,478 | 3/1980 | Keller et al. | 187/101 |
| 4,246,983 | 1/1981 | Bril | 187/101 |
| 4,337,847 | 7/1982 | Schroder et al. | 187/101 |
| 4,410,959 | 10/1983 | Tajima et al. | 187/102 X |

FOREIGN PATENT DOCUMENTS

| | | | |
|---|---|---|---|
| 58-144072 | 8/1983 | Japan . | |
| 2128369 | 4/1984 | United Kingdom | 187/101 |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

In a case where peculiar control information which differs depending upon buildings is revised, a first memory for storing the revised information and a second memory for storing the original information before the revision are disposed, and addresses and contents are correspondingly stored in both the memories, whereupon the stored contents of both the memories are displayed on a display unit at the respectively corresponding addresses. Thus, the presence or absence of an alteration error in the case of the revision of the control information can be reliably checked.

3 Claims, 5 Drawing Figures

FIG. 1

| ADDRESS | DATA |
|---|---|
| A | D0 |
| A + 1 | D1 |
| A + 2 | D2 |
| ⋮ | ⋮ |
| A + n | Dn |
| B | D0 |
| B + 1 | D1 |
| B + 2 | D2 |
| ⋮ | ⋮ |
| B + n | Dn |

4

41

42

CONTROL APPARATUS FOR ELEVATOR

BACKGROUND OF THE INVENTION

This invention relates to an apparatus which controls an elevator by the use of an electronic computer.

FIG. 5 is a block diagram exemplarily showing a prior-art control apparatus for an elevator disclosed in the official gazette of Japanese Patent Application Laid-open No. 58-144072.

Referring to the figure, numeral 1 designates a CPU (central processing unit), and numeral 2 designates signal lines such as an address bus, data bus and control bus. A memory 3 stores a program for controlling the elevator, a memory 4 stores control information items peculiar to a building, such as the number of floors to be served and a stand-by floor during a slack hour, and a memory 5 stores the calculated results of the CPU 1. An elevator appliance 6 is installed in each of the cages and halls of the elevator. A converter 7 performs the conversion of information between the CPU 1 and the elevator appliance 6 (such as voltage level conversion, analog/digital conversion and serial/parallel conversion).

In the prior-art elevator control apparatus constructed as described above, the CPU 1 executes operations on the basis of the information of the memory 4 and the information of the elevator appliance 6 received through the converter 7, in accordance with the program stored in the memory 3 and while utilizing the memory 5, whereupon it controls the elevator appliance 6 through the converter 7.

Usually, the memory 3 is a read-only nonvolatile memory (hereinbelow, termed "ROM") the stored contents of which are held even when power supply is cut off, while the memory 5 is a volatile memory (hereinbelow, termed "RAM") the stored contents of which are held only while a supply voltage is fed, and from and into which data can be read and written. As the memory 4, a ROM which is similar to the memory 3 or a setting unit in which the "on" and "off" states of a switch correspond to binary numbers "1" and "0" respectively was common in the past, but a nonvolatile memory (for example, EEPROM) from and into which data can be electrically read and written and the stored contents of which are held even when power supply is cut off has come into use in recent years. The reasons therefor are as follows: With the ROM, in a case where the control information is to be altered due to change in the stand-by floor during the slack hour or increase in the number of floors of the building, the ROM needs to be replaced, and this expends time and labor. On the other hand, with the setting unit, one switch corresponds to one bit, and hence, the cost relative to the amount of information is high. In contrast, when the EEPROM is employed by way of example, data can be rewritten, so that the ROM need not be replaced even in the case of altering the control information, and moreover, the cost of the EEPROM relative to the amount of information is low.

In the prior-art elevator control apparatus as described above, in the case where the ROM from and into which data can be electrically read and written is used as the memory 4 for storing the control information peculiar to the building, it has a single area for storing the control information items. Therefore, when any control information has been altered, the whole storage area needs to be checked for acknowledging the absence of an alteration error. This leads to the problems that labor is expended, and that a check error is prone to arise because the number of information items to be checked is large.

SUMMARY OF THE INVENTION

This invention has been made in order to solve the problems stated above, and has for its object to provide a control apparatus for an elevator in which, when a control information item has been altered, the absence of an alteration error can be reliably checked.

Another object of the present invention is to provide a control apparatus for an elevator in which the aforementioned check can be done with ease.

A control apparatus for an elevator according to this invention comprises a memory which includes first storage means and besides second storage means for storing control information items peculiar to a building at corresponding storage addresses, in which the first storage means stores revised (altered) control information items, while the second storage means stores original information items remaining unrevised, and also comprises display means for displaying the stored contents of both the storage means at the respectively corresponding addresses.

Besides, another control apparatus for an elevator according to this invention further comprises comparison means to compare the contents of the first and second storage means and to deliver a discrepant part as an output, this output of the comparison means being displayed by the display means.

In this invention, even when the content of the first storage means has been altered, the original data corresponding thereto is kept stored in the second storage means, and hence, the alteration part is not mistaken.

Besides, in this invention, when the discrepant part is found by the comparisions of the contents of the first and second storage means in the comparison means, the contents thereof are automatically displayed.

BRIEF DESCRIPTION OF THE DRAWINGS

FIG. 1 is a content diagram of a memory showing an embodiment of a control apparatus for an elevator according to this invention;

FIGS. 2–4 are diagrams showing another embodiment of this invention, in which FIG. 2 is a general arrangement diagram, FIG. 3 is a block diagram and FIG. 4 is a flow chart of a data comparison program.

DESCRIPTION OF THE PREFERRED EMBODIMENTS

Figure 5:
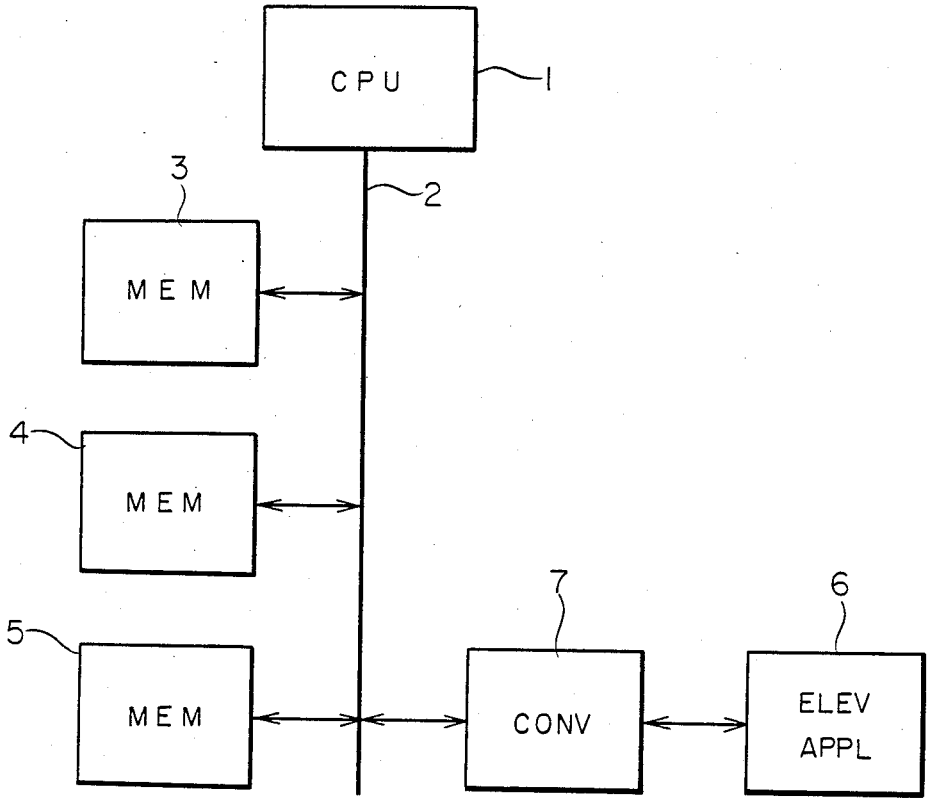
FIG. 5 PRIOR ART
FIG. 5 is a block diagram for explaining control apparatuses for an elevator according to this invention and in a prior art.

FIGS. 1 and 5 are diagrams showing one embodiment of this invention. FIG. 1 lists the contents of a memory 4, and portions 1–7 except this memory 4 are similar to those of the prior-art apparatus described before.

The memory 4 in FIG. 1 is an EEPROM which stores control information items peculiar to a building, and which has a first storage area 41 and a second storage area 42. At first, pairs of data items $D_0$, $D_1$, $D_2$, . . . and $D_n$ identical to each other are respectively stored at the addresses A, A+1, A+2, . . . and A+n of the first storage area 41 and the corresponding addresses B, B+1, B+2, . . . and B+n of the second storage area 42.

Regarding the control apparatus for an elevator constructed as stated above, there will be described a case where the number of service floors of the elevator is changed from ten to eleven by reason of increase in the number of floors of the building.

The same data items are first stored at the respectively corresponding addresses of the first and second storage areas 41 and 42 of the memory 4. More specifically, assuming that the number of service floors be stored at the address (A+2) of the first storage area 41, both the data of this address (A+2) and the data of the address (B+2) of the second storage area 42 are $D_2=10$. Here, it is supposed that the data of the address (A+2) have been altered to 11 on account of the specification change stated above. In case of checking the alteration, the contents of the memory 4 are read out and displayed, and the corresponding data items of the first and second storage areas 41 and 42 are compared. Then, the data of the address (A+2) is 11, and that of the address (B+2) is 10, so that the discrepant part is found out. In this way, it can be acknowledged that the number of service floors has been altered from 10 to 11 without fail.

Figure 2:
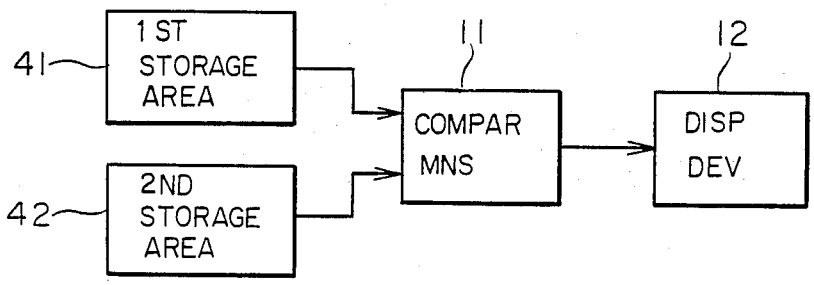
Figure 3:
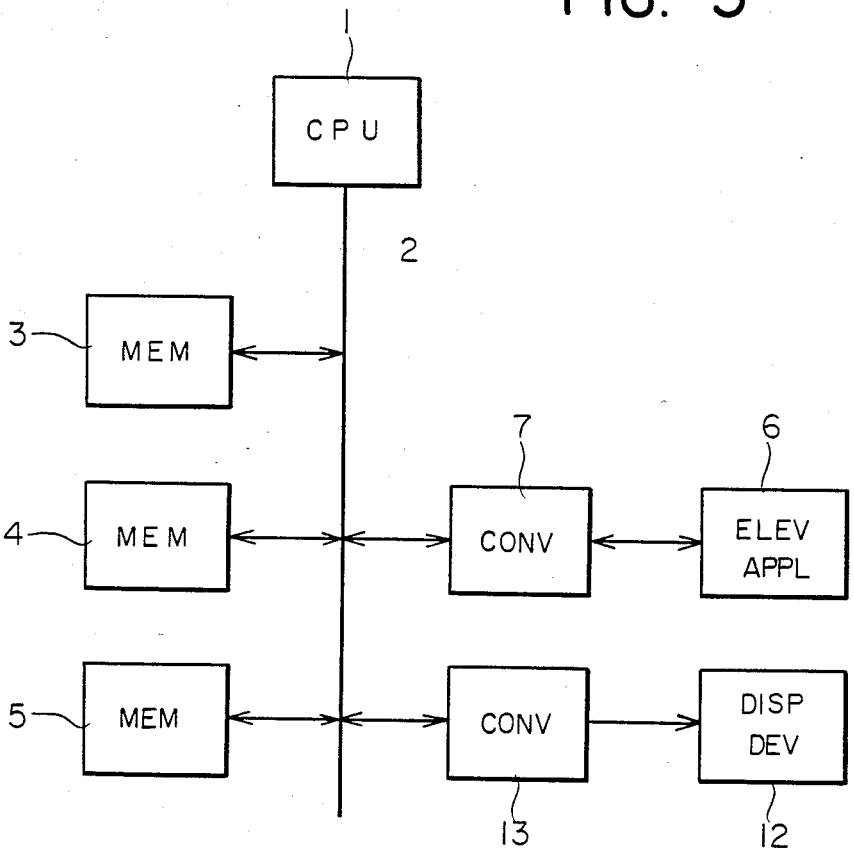
Figure 4:
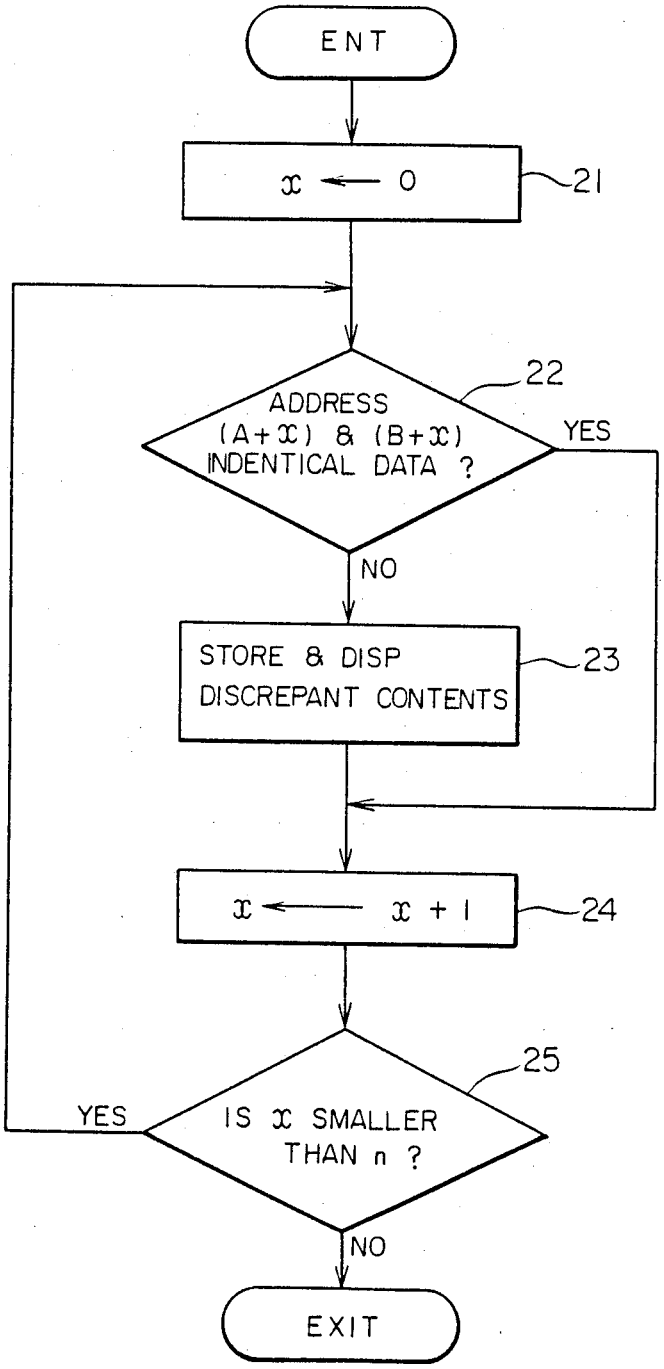

FIGS. 2–4 are diagrams showing another embodiment of this invention, in which the contents of the first and second storage areas 41 and 42 of a memory 4 are compared within an electronic computer.

As understood from FIG. 2 which is a general arrangement diagram, this embodiment is so constructed that comparison means 11 is comprised for comparing the contents of the first and second storage areas 41 and 42 of the memory 4 shown in FIG. 1 and for delivering different data items at corresponding addresses, and that the different data items are displayed by a display device 12.

FIG. 3 is a block diagram of this embodiment. As seen from the figure, the display device 12 and a converter 13 for converting information to be fed from a CPU 1 to the display device 12 are added to the construction of FIG. 5 (the prior art). A printer, a CRT or the like is usually employed as the display device 12.

Now, the operation of the embodiment will be described with reference to FIG. 4. This figure is a flow chart showing a data comparison program stored in the memory 3.

First, at a step 21, × (0, 1, 2, . . . ) is set at zero, whereby the start addresses of data items to be compared are initialized. At a step 22, the data items of the corresponding addresses (A+x) and (B+x) of the first and second storage areas 41 and 42 are read out and compared, to decide if they are identical. When the data items are identical, the control flow proceeds to a step 24. On the other hand, when they are different, the addresses and the data items are stored and are displayed on the display device 12 through the converter 13 at a step 23. Next, at the step 24, x is set at (x+1) to increment the addresses to-be-compared. At a step 25, whether or not x is smaller than n is decided. When x is smaller than n, the comparisons of data items in the whole areas are not over, and hence, the control flow returns to the step 22 so as to repeat the steps 22–25. When x=n holds at the step 25, the comparisons in the whole areas are over.

In this way, in the above case where the number of floors to be served has been altered from 10 to 11, the data of the address (A+2) is 11 while that of the address (B+2) is 10, and this discrepant part is displayed.

In each of the foregoing embodiments, the memory 4 has been divided into the two portions of the first storage area 41 for the elevator control and the second storage area 42 for the initial data. It is also possible, however, to divide the memory 4 into three or more portions or to prepare individual memories for respective purposes.

In order to prevent the initial data from being erroneously rewritten, the area or areas other than the first storage area 41 may well be rendered incapable of rewriting data. It is also allowed that an input unit for the control information be separated from the elevator and be constructed of the so-called pocket computer, and that the data comparison program in FIG. 4 be set in the pocket computer side.

As described above, according to this invention, in case of revising control information peculiar to a building, first storage means for storing the revised information item and second storage means for storing the original information before the revision are disposed, and the stored contents of both the storage means are displayed on a display unit. This produces the effect that, when the control information has been altered, the absence of an alteration error can be reliably checked.

Moreover, according to this invention, comparison means for comparing the contents of the first and second storage means and delivering a discrepant part as an output is disposed, and the ouput of the comparison means is displayed by a display device. This produces the effect that the discrepancy of the contents is automatically checked and that the propriety of the stored contents is readily acknowledged.

What is claimed is:

1. In an elevator which is installed in a building and which is controlled by control means constructed of an electronic computer that has a memory storing information for control; a control apparatus for an elevator comprising:

(a) first storage means to store control information items which are peculiar to the building and which might be revised, at a plurality of separate addresses, so that when any of the control information items is revised, the stored content at the address corresponding to the information item is revised and stored, whereupon the stored contents of said first storage means including the revised information item are used for the elevator control, (b) second control means to store the control information items at a plurality of separate addresses corresponding to the addresses of said first storage means, these information items being left unrevised, so that the original control information items before being revised are normally stored in said second storage means, and (c) display means to display the contents of said first and second storage means at the respectively corresponding addresses.

2. A control apparatus for an elevator as defined in claim 1, wherein both said first storage means and said second storage means store the identical control information items at the respectively corresponding addresses in an intial state of the elevator control, and central processing means is further comprise to perform a control under which, when any of the control information items is revised, only said first storage means stores the revised control information item at the corresponding address.

3. A control apparatus for an elevator as defined in claim 1, further comprising comparison means to compare the stored contents of said first storage means and said second storage means at the respectively corresponding addresses and to provide an output when the stored contents are discrepant from each other, so that said display means displays the discrepant stored contents of both said storage means in response to the output of said comparison means.

* * * * *